United States Patent [19]

Saunders

[11] Patent Number: 4,988,122

[45] Date of Patent: Jan. 29, 1991

[54] ROLL ICE SHOE

[76] Inventor: Adah W. Saunders, 41-10 Bowne St., Apt. 7-V, Flushing, N.Y. 11355

[21] Appl. No.: 472,969

[22] Filed: Jan. 31, 1990

[51] Int. Cl.[5] ..... A63C 1/00

[52] U.S. Cl. ..... 280/841; 280/11.12; 280/11.19; 36/101

[58] Field of Search ..... 280/11.19, 11.22, 841, 280/11.12, 8; 36/100, 101, 115

[56] References Cited

U.S. PATENT DOCUMENTS 3,292,940 12/1966 Weitzner ..... 280/11.12

4,150,499 4/1979 Wang ..... 280/841

*Primary Examiner*—Charles A. Marmor

*Assistant Examiner*—Richard Camby

*Attorney, Agent, or Firm*—Richard L. Miller

[57] ABSTRACT

A combination roller skate and ice skate is provided and consists of a boot affixed to top of an elongated base member and a structure for removably attaching a roller skate insert to bottom of the base member so that a person wearing the boot can roller skate. The structure is also for removably attaching an ice skate insert to bottom of the base member so that the person wearing the boot can ice skate.

3 Claims, 1 Drawing Sheet

ROLL ICE SHOE

BACKGROUND OF THE INVENTION

The instant invention relates generally to skates and more specifically it relates to a combination interchangeable roller skate and ice skate.

Numerous skates have been provided in the prior art that are adapted to either roller type skates that are used on flat hard surfaces or ice skates that are used on flat ice surfaces. While these units may be suitable for the particular purpose to which they address, they would not be as suitable for the purpose of the present invention as hereafter described.

SUMMARY OF THE INVENTION

A primary object of the present invention is to provide a combination roller skate and ice skate device that will overcome the shortcomings of the prior art devices.

Another object is to provide a combination roller skate and ice skate in which both a roller skate insert attachment and an ice skate insert attachment can be utilized with a boot so that a person can either go roller skating or ice skating using the same boot.

An additional object is to provide a combination roller skate and ice skate in which when the insert attachments are not used a person can walk steadily on a floor when just wearing the boot.

A further object is to provide a combination roller skate and ice skate that is simple and easy to use.

A still further object is to provide a combination roller skate and ice skate that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
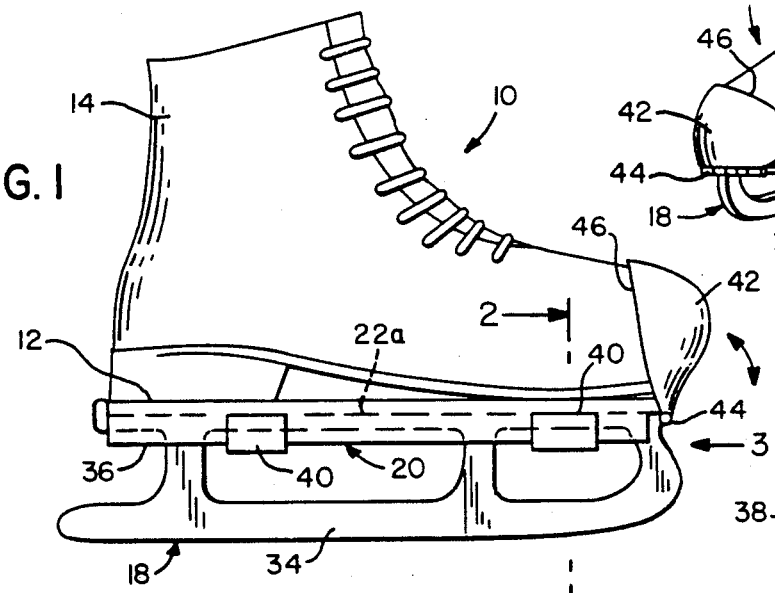
FIG. 1 is a side view of the invention used as an ice skate.
Figure 6:
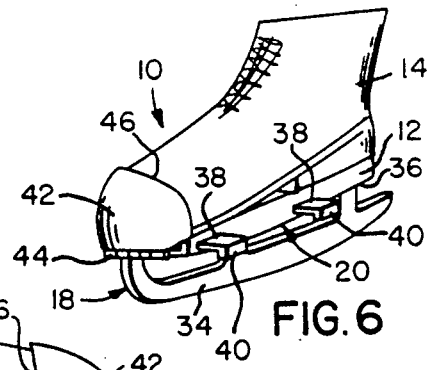
FIG. 6 is a perspective view of the invention with the tongue partly pulled out therefrom.
Figure 5:
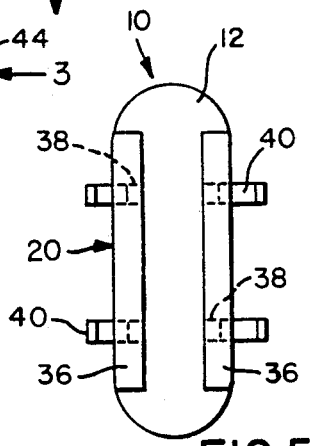
FIG. 5 is a bottom view of the base portion of the invention showing the tracks thereon.
Figure 2:
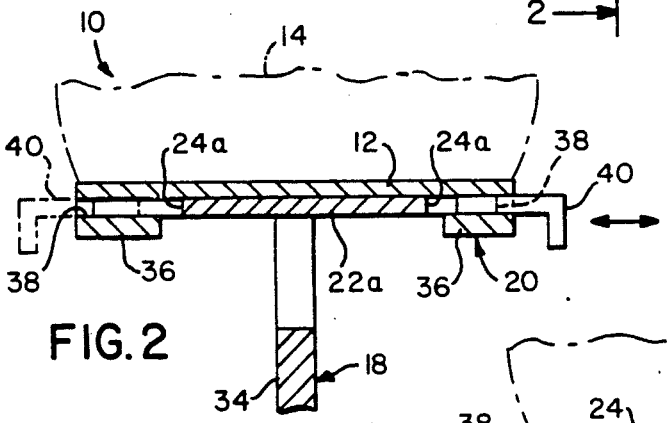
FIG. 2 is an enlarged cross sectional view taken along line 2—2 in FIG. 1.
Figure 3:
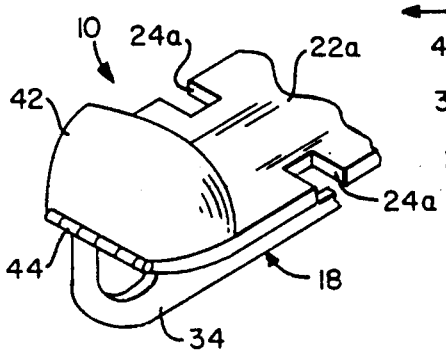
FIG. 3 is a partial perspective view taken in direction of arrow 3 in FIG. 1 showing the toe protector in greater detail.
Figure 4:
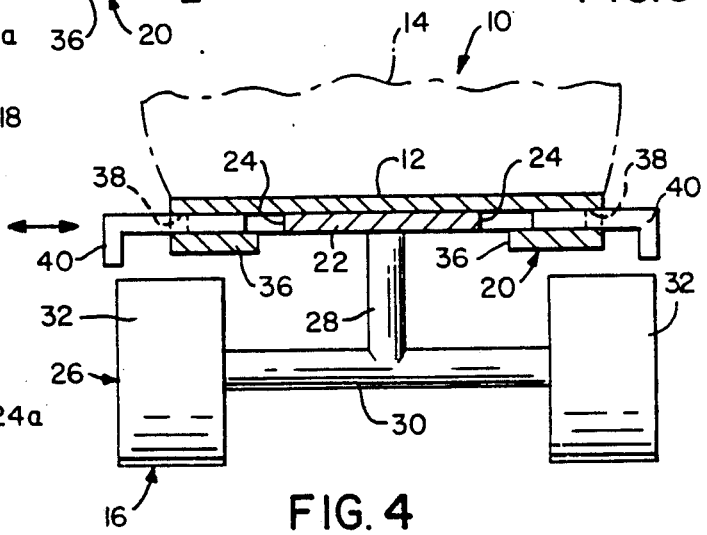
FIG. 4 is an enlarged cross sectional view similar to FIG. 2 showing the invention used as a roller skate.

Turning now descriptively to the drawings, in which like reference characters denote like elements throughout the several views, the Figures illustrate a combination roller skate and ice skate 10 containing an elongated base member 12, a boot 14 affixed to top of the base member 12, a roller skate insert 16 and an ice skate insert 18. A structure 20 is provided for removably attaching the roller skate insert 16 to bottom of the base member 12 so that a person wearing the boot 14 can roller skate. The structure 20 is also provided for removably attaching the roller skate insert 16 to bottom of the base member 12 so that a person wearing the boot 14 can roller skate. The structure 20 is also provided for removably attaching the ice skate insert 18 to bottom of the base member 12 so that the person wearing the boot 14 can ice skate.

The roller skate insert 16 includes an elongated plate 22 having a plurality of spaced apart notches 24 on each long side thereof. A pair of wheel assemblies 26 are also utilized. One of the wheel assemblies 26 extends downwardly from front of the plate 22, while other of the wheel assemblies 26 extends downward from rear of the plate 22. Each wheel assembly 26 includes a vertical center shaft 28, an axle 30 affixed to the shaft 28 and a pair of wheels 32, each rotatively connected to one end of the axle 30.

The ice skate insert 18 includes an elongated plate **22*a* having a plurality of spaced apart notches 24*a* on each long side thereof. A blade 34 extends downwardly from center of the plate 22'**.

The removably attaching structure 20 includes a pair of tracks 36 in which each is formed on underside along one long side thereof and has a plurality of spaced apart transverse slots 38 extending therein. An L-shaped tongue 40 is insertable into each of the slots 38 so that in one instance the plate 22 of the roller skate insert 16 can be inserted between the tracks 36 with the notches 24 in alignment with the slots 38 enabling the tongues 40 to enter the notches 24 to lock the roller skate insert 16 thereto. In another instance the plate **22*a* of the ice skate insert 18 can be inserted between the tracks 36 with the notches 24*a* in alignment with the slots 38 enabling the tongues 40 to enter the notches 24*a* to lock the ice skate insert 18** thereto.

A magnetic toe protector 42 is hingably connected at 44 to front edge of the plate 22 of the roller skate insert 16 and the plate **22*a* of the ice skate insert 18. The boot 14 has a magnetic toe tip 46 to hold the magnetic toe protector 42 thereto when the plate 22 or 22*a* is inserted between the tracks 36**.

When the roller skate insert 16 and the ice skate insert 18 is not used they can be removed from the base member 12 so that the person wearing the boot 14 can walk steadily upon a floor.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A combination roller skate and ice skate comprising:

(a) an elongated base member;

(b) a boot affixed to a top of said elongated base member;

(c) a roller skate insert; wherein said roller skate insert includes:

(i) an elongated plate having a plurality of spaced apart notches on each long side thereof; and (ii) a pair of wheel assemblies, one of said wheel assemblies extending downwardly from front of said plate while other of said wheel assemblies extending downwardly from rear of said plate.

(d) an ice skate insert; wherein said ice skate insert includes:

(i) an elongated plate having a plurality of spaced apart notches on each long side thereof; and (ii) a blade extending downwardly from center of said plate (e) means for removably attaching said roller skate insert to the bottom of said base member so that a person wearing said boot can roller skate, and for removably attaching said ice skate insert to bottom of said base member so that the person wearing said boot can ice skate; wherein said means for removably attaching includes:

(i) a pair of tracks, each said track formed on an underside of said elongated bare member along one long side thereof and having a plurality of spaced apart transverse slots extending therein; and (ii) a plurality of L-shaped tongues insertable into said slots so that in one instance said elongated plate of said roller skate insert can be inserted between said tracks with said notches in alignment with said slots enabling said v-shaped tongues to enter said notches to lock said roller skate insert thereto and in another instance said elongated plate of said ice skate insert can be inserted between said tracks with said notches in alignment with said slots enabling said v-shaped tongues to enter said notches to lock said ice skate insert thereto.

2. A combination roller skate and ice skate as recited in claim 1 further including:

(a) a magnetic toe protector hingably connected to a front edge of said elongated plate of said roller skate insert; and (b) said boot having a magnetic toe tip to hold said magnetic toe protector thereto when said elongated plate is inserted between said tracks.

3. A combination roller skate and ice skate as recited in claim 2 further including:

(a) a magnetic toe protector hingably connected to front edge of said elongated plate of said ice skate insert; and (b) said boot having a magnetic toe tip to hold said magnetic toe protector thereto when said elongated plate is inserted between said tracks.

* * * * *